US007438012B2

(12) United States Patent
Kackur

(10) Patent No.: US 7,438,012 B2
(45) Date of Patent: Oct. 21, 2008

(54) GAS SUPPLY ARRANGEMENT OF A MARINE VESSEL AND METHOD OF PROVIDING GAS IN A MARINE VESSEL

(75) Inventor: Johnny Kackur, Turku (FI)

(73) Assignee: Wartsila Finland Oy, Vaasa (FI)

( * ) Notice: Subject to any disclaimer, the term of this patent is extended or adjusted under 35 U.S.C. 154(b) by 0 days.

(21) Appl. No.: 10/598,949

(22) PCT Filed: Mar. 10, 2005

(86) PCT No.: PCT/FI2005/050072

§ 371 (c)(1),
(2), (4) Date: Sep. 22, 2006

(87) PCT Pub. No.: WO2005/087586

PCT Pub. Date: Sep. 22, 2005

(65) Prior Publication Data

US 2007/0199496 A1 Aug. 30, 2007

(30) Foreign Application Priority Data

Mar. 17, 2004 (FI) ..... 20045081

(51) Int. Cl.
*B63B 25/08* (2006.01)

(52) U.S. Cl. ..... 114/74 A

(58) Field of Classification Search ..... 114/74 A
See application file for complete search history.

(56) References Cited

U.S. PATENT DOCUMENTS

| | | | | |
|---|---|---|---|---|
| 5,398,515 | A * | 3/1995 | Lak | 62/47.1 |
| 5,411,374 | A * | 5/1995 | Gram | 417/53 |
| 5,590,535 | A | 1/1997 | Rhoades et al. | |
| 2003/0054307 | A1 * | 3/2003 | Gerstendorfer et al. | 431/117 |

FOREIGN PATENT DOCUMENTS

| | | |
|---|---|---|
| EP | 1348620 | 10/2003 |
| JP | 62237200 | 10/1987 |
| JP | 2000018322 | 1/2000 |
| JP | 2002022096 | 1/2002 |
| WO | 0037847 | 6/2000 |

* cited by examiner

*Primary Examiner*—Stephen Avila
(74) *Attorney, Agent, or Firm*—Smith-Hill and Bedell

(57) ABSTRACT

Gas supply arrangement of a marine vessel being adapted to carry liquefied gas in its gas tank having an ullage space section and a liquid phase section, which arrangement provides the gas for demands of the vessel, the arrangement comprising a gas supply line provided for delivering the gas formed in the gas tank to a consumption device, and a piping extending from the liquid phase section to the ullage space section of the gas tank being provided with at least a pump, for introducing gas into the ullage space section. The piping is provided with a heat transfer unit for effecting on the temperature of the introduced gas. The invention relates also to method of providing gas in a marine vessel with liquefied gas tank.

5 Claims, 1 Drawing Sheet

GAS SUPPLY ARRANGEMENT OF A MARINE VESSEL AND METHOD OF PROVIDING GAS IN A MARINE VESSEL

This is a national stage application filed under 35 USC 371 based on International Application No. PCT/FI2005/050072 filed Mar. 10, 2005, and claims priority under 35 USC 119 of Finnish Patent Application No. 20045081 filed Mar. 17, 2004.

BACKGROUND OF THE INVENTION

This invention relates to a gas supply arrangement of a marine vessel and to a method of providing gas in a gas supply arrangement of a marine vessel.

The usage of gas as energy source in marine vessels is advantageous due to its efficient burning and low emissions. Usually gas is stored in liquefied form because less space is required for the storage that way.

The propulsion system of LNG (Liquified Natural Gas) tankers is usually powered by making use of the cargo. Storing of the gas in the tanker is arranged by using heat insulated cargo tanks into which an ullage space section and a liquid phase section are formed. The pressure in the cargo tanks is approximately at atmospheric pressure level and the temperature of the liquefied gas is about minus 163° C. Although the insulation of the cargo tank is extremely good, gradually increasing of the LNG temperature causes formation of so called natural boil-off gas. The boil-off gas must be removed in order to avoid extensive increasing of pressure in the cargo tanks, that is because the cargo tanks are very sensitive to pressure changes. The boil-off gas may be utilised in tanker's consumption devices like propulsion system. However, the amount of natural boil-off gas is not sufficient for providing all propulsion energy required in all circumstances and therefore the vessel must be provided with additional means for acquiring extra gas, so called forced boil-off gas.

For example in a patent publication FR 2722760 there is shown an arrangement in which liquid gas is supplied to a forced boiling vaporiser in which the liquid gas vaporises into gas form, which in turn may be combined with the natural boil-off gas stream.

EP 1348620 A1 shows a gas supply apparatus in which the natural boil-off gas is led to a compressor, which increase the pressure of the gas prior to feeding it to consumption via a feed line. Additionally, the apparatus also includes a forced boiling vaporiser in which the liquid gas previously pumped to the higher pressure is vaporised. In this arrangement the forced boiling gas portion is combined to the natural boil-off gas after the pressure of the natural boil-off gas has been increased. It is, however, somewhat complicated system requiring two parallel gas feed systems from the cargo tank to gas main supply line. That kind of an arrangement requires also somewhat complicated control system.

An objective of the invention is to provide a gas supply arrangement for a marine vessel, which solves the above mentioned and other problems of the prior art. It is also an objective of the invention to provide a straightforward and reliable arrangement and method for a marine vessel with liquefied gas tank, which provides even pressure at the supply line and reliable gas supply for consumption devices of the vessel.

SUMMARY OF THE INVENTION

In the following the invention will be described with a reference mainly to one gas tank. However, it is clear that a marine vessel may be provided with several gas tanks each having an individual gas supply arrangement or several gas tanks may be connected parallel having a shared gas supply arrangement.

Gas supply arrangement of a marine vessel being adapted to carry liquefied gas in its gas tank having an ullage space section and a liquid phase section. According to the invention arrangement provides gas for demands of the vessel, the arrangement comprising a gas supply line provided for delivering the gas formed in the gas tank to a consumption device. The basic idea of the invention is to controllably evaporate gas in the gas tank itself by providing advantageous circumstances for phase transition phenomenon particularly in the ullage space section and/or above the surface of the liquid phase section.

According to a preferred embodiment the arrangement is provided with a piping extending from the liquid phase section to the ullage space section of the gas tank being provided with at least a pump, for introducing gas into the ullage space section. The piping is provided with a heat transfer unit for effecting on the temperature of the introduced gas. This way the arrangement is capable of producing controllable amount of gaseous gas for the demands of the vessel. The arrangement is advantageously provided with a first sensor, which is adapted for measuring the pressure in the ullage space section of the gas tank. The piping is provided with a control valve for controlling the flow of the gas in the piping and the first sensor is arranged in control communication with the control valve. This way the flow rate of the gas through the piping is controlled based on the measured pressure in the ullage space section of the gas tank.

The heat transfer unit comprises a heat exchanger. The heat exchanger is arranged in the piping so that the gas may flow through it. The piping is provided also with a bypass conduit passing by the heat exchanger and with a three-way valve for controlling the gas flow between the heat exchanger and the bypass conduit. The arrangement is advantageously provided with a second sensor, which is adapted for measuring the temperature in the ullage space section of the gas tank. The second sensor is arranged in control communication with the three-way valve, which thus divides the flow of gas between the heat exchanger and the bypass conduit based on the temperature prevailing the ullage space section.

According to the invention, in the method of providing gas a marine vessel with liquefied gas tank having an ullage space section and liquid phase section, and a gas consumption device, gas is evaporated in the gas tank and led to the consumption device via a gas supply line. Simultaneously the pressure in the gas tank is substantially continuously measured by a first sensor. The evaporation rate of the gas in the gas tank is controlled by controllably spraying liquefied gas into the ullage space section and the flow rate of sprayed liquefied gas is controlled based on the pressure measurement of the first sensor. This way circumstances for phase transition phenomenon in the ullage space section and/or above the surface of the liquid phase section is provided, and the phase transition controlled based on the pressure measurement of the first sensor.

The temperature of the sprayed gas is controlled based on temperature value measured by a second sensor provided in connection with the gas tank ullage space section.

The invention has several advantages. First of all, the number of required components is minimised, which leads to easy and space-saving installation. The pressure and gaseous gas production control is also very accurate due to the novel way of controlling the pressure. With the invention it is also possible to provide more suitable gas for gas engine operation by minimising the evaporation of the heavy hydrocarbons from the liquefied gas.

BRIEF DESCRIPTION OF THE DRAWINGS

In the following the invention will be described with the reference to the accompanying schematic drawing, in which.

DETAILED DESCRIPTION

Figure 1:
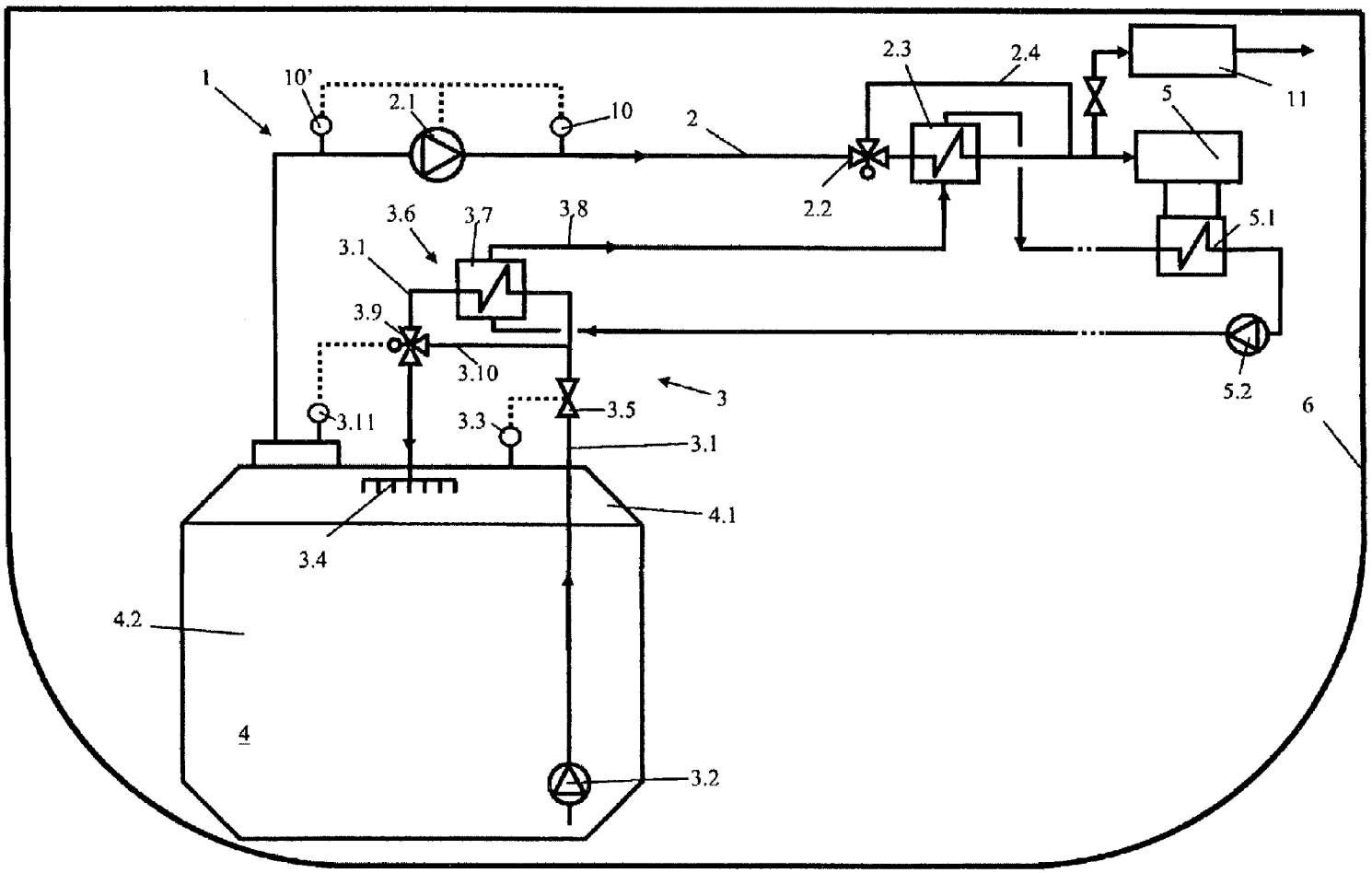
figure 1 shows an exemplary embodiment of the 20 gas supply arrangement according to the invention.

FIG. 1 depicts schematically cross section of a marine vessel 6, like LNG tanker. The vessel 6 is adapted to carry liquefied gas in its gas tanks 4. Normally there are several tanks in an LNG tanker, but in the figure only one gas tank 4 is shown for clarity reasons. The gas tank 4 is filled so that there is always an ullage space section 4.1 filled with gas in gaseous form and a liquid phase section 4.2 filled with liquefied gas. During the storing of the liquefied gas the gas is evaporating changing its phase and transferring to the ullage space 4.1 section. The evaporated gas may be utilised in a consumption device 5 of the vessel 6. The consumption device 5 may be e.g. a gas engine providing propulsion power for the vessel. In the FIG. 1 there is only one consumption device 5 is shown but it is clear that there may be several devices.

The vessel 6 is provided with a gas supply arrangement 1, which comprises a gas supply line 2 being provided with a compressor unit 2.1. The gas supply line 2 extends from an ullage space section 4.1 of the gas tank 4 to a consumption device 5. Other gas tanks (not shown) are also connected to inlet side of the compressor unit 2.1 correspondingly. The gas supply line 2 is arranged for delivering the evaporated boil-off gas from the gas tank 4 to the consumption device 5 of the vessel 6. The gas tank 4 is maintained slightly over-pressurised. The gas supply line 2 is provided with the compressor unit 2.1 for maintaining the pressure in the gas tank 4 at desired level and for raising the pressure of the boil-off gas to an adequate level for usage in the consumption device 5. The lower limit is typically ruled by requirements of the gas engines of the vessel being as the consumption device 5. Desired pressure level in the gas tank 4 is maintained by the compressor unit 2.1 The compressor unit 2.1 is preferably controlled by making use of a first pressure measurement device 10 provided in the gas supply line 2 after the compressor and a second pressure measurement device 10' provided in the gas supply line 2 before the compressor. The compressor unit may be provided with inlet vane control, which allows certain variation in the capacity. In case the pressure in the gas main supply line (measured by the device 10) is decreasing and simultaneously the pressure in the gas tank is too low, an alternate way of producing greater amount of gas must be provided. This will be described in the following.

The gas tank 4 is provided with arrangement 3 for producing gaseous gas from the liquefied gas in the gas tank 4. The arrangement shown in the figure comprises a piping 3.1, which extends from the liquid phase section 4.2 to the ullage space section 4.1 of the gas tank 4. Even not shown it is conceivable to arrange the piping extending between two separate gas tanks. The piping comprises a pump 3.2, positioned preferably at the liquid phase section of the gas tank 4. The other end of the piping 3.1 is provided with a nozzle unit 3.4, which is arranged to open into the ullage space section 4.1 of the gas tank 4. The piping is also provided with a control valve 3.5 for controlling the flow rate in the piping 3.1. In practise the piping comprise any suitable ducting, like tube system or channels integral to other devices in the arrangement.

Additionally there is a heat transfer unit 3.6 provided in the piping 3.1 by means of which it is possible to control the temperature of the sprayed liquefied gas. The heat transfer unit is provided with a heat exchanger 3.7 arranged in the piping after the control valve 3.5 in the gas flow direction, through which gas may flow and heat up. The heat exchanger 3.7 is connected to a heat transfer circuit 3.8 in which e.g. water-glycol mixture is arranged to flow for heating the gas. The heat transfer circuit 3.8 may also be connected to a second heat exchanger 2.3 for controlling the temperature of the gas in the gas supply line 2 and a third heat exchanger 5.1 recovering heat from the consumption device 5. This way excess heat in the consumption device 5 may be utilised effectively. As shown schematically by the dotted lines the heat transfer circuit may include also other parts and elements.

The piping 3.1 is additionally provided with a bypass conduit 3.10 through which gas may pass by the heat exchanger 3.7. The bypass flow is con-trolled by a three-way valve 3.9, which is positioned in the piping after the heat ex-changer 3.7 in the gas flow direction. The three-way valve combines the flow routes through the heat exchanger 3.7 and through the bypass conduit 3.10. This coupling provides a gas temperature control function for the gas sprayed through the nozzle unit 3.4.

In connection with the gas tank there are at least two sensors provided, which have been provided to be used for operating of the gas supply arrangement 1. A first sensor 3.3 is provided for measuring the pressure in the ullage space section 4.1 of the gas tank 4 and a second sensor 3.11 is provided for measuring the temperature in the ullage space section 4.1 of the gas tank 4.

The basic idea of the invention is to controllably evaporate gas in the gas tank 4 by providing advantageous circumstances for phase transition phenomenon particularly in the ullage space section and/or above the surface of the liquid phase section. This is advantageously accomplished as explained in the following. Liquefied gas is introduced from the liquid phase section to the ullage space section without substantially increasing the temperature of the liquefied gas in liquid phase section of the tank. The temperature in the ullage space section 4.1 is higher than the temperature of the liquefied gas and in the present invention this fact is controllably utilised in connection with controlling the evaporation of the gas.

When the amount of natural boil-off gas is not enough to feed the consumption device 5 additional boil-off gas is needed. According to the invention, greater amount of gas than produced by natural evaporation may be accomplished by controllably spraying liquefied gas in to the ullage space section 4.1. An actuator of the valve 3.5 is controlled making use of the pressure value obtained from the first sensor 3.3. In case the consumption of the gas increases through the gas supply line 2 the pressure in the ullage space section will decrease, which will be registered by a control system (not shown) based on the measurement of the first sensor 3.3. Subsequently the control system will drive the valve 3.5 to open more, which causes the flow rate of sprayed gas to increase. Naturally the pump 3.2 is in operation also. The flow pattern of the sprayed gas is such that the droplets are very small or possibly even mist. Since the temperature in the ullage space section is higher than the liquefied gas, a part of the sprayed gas will evaporate, and thus compensate the consumption of the gas, and also the pressure drop in the ullage space section. Thus advantageous circumstances for phase transition phenomenon in the ullage space section and/or above the surface of the liquid phase section are provided. This way the pressure level in the ullage space section 4.1 is maintained at desired level and also additional gas is produced from the liquefied gas according to the invention.

The evaporation of the gas consumes energy and the temperature in the ullage space section tends to decrease accordingly while gas is evaporated. The temperature in the ullage space section 4.1 is registered by a control system (not shown) based on the measurement of the second sensor 3.11. Now the control system will drive the three-way valve 3.9 to pass more gas through the heat exchanger 3.7 and warm up the sprayed gas. This result in less heat consumption in the evaporation of the gas. According to the invention the temperature of the sprayed gas is maintained approximately at minus 130° C. Maintaining the gas approximately at this temperature assists the fractionation of gas in a manner that, for the most part, only nitrogen and methane will be evaporated. The heavier hydrocarbons contained by the liquefied gas will remain in liquid phase and return to the liquid phase section 4.1 of the gas tank 4.

For ballast conditions there may be a connection between at least two tanks (no shown) in order to transfer liquefied gas from one tank to other. It is also possible to leave the tank properly filled for ballast voyage.

For situations when there will be a low load on the consumption device 5, a thermal oxidiser 11 is installed. The intention is to burn all surplus boil-off gas in the thermal oxidiser when the boil-off gas production from the gas tank is higher than the consumption. Control dependencies in the FIG. 1 is shown informally by dotted lines for clarity reasons. However, it is clear that the control system may be realised by various manners, using centralised or distributed control arrangements.

The invention is not limited to the embodiment shown but several modifications of the invention are conceivable within the scope of the appending claims.

The invention claimed is:

1. A gas supply arrangement of a marine vessel adapted to carry liquefied gas in a gas tank having an ullage space section and a liquid phase section, which arrangement provides gas for demands of the vessel, the arrangement comprising:

a gas supply line for delivering gas formed in the gas tank to a consumption device, and a piping extending from the liquid phase section of the gas tank to the ullage space section of the gas tank, wherein said piping is provided with a pump for introducing gas into the ullage space section, a heat transfer unit for influencing the temperature of the gas introduced into the ullage space section, a bypass conduit passing by the heat transfer unit, and a three-way valve for controlling the gas flow between the heat transfer unit and the bypass conduit, and wherein the heat transfer unit comprises a heat exchanger arranged in the piping.

2. A gas supply arrangement according to claim 1, comprising a first sensor adapted for measuring the pressure in the ullage space section of the gas tank, and wherein the piping is provided with a control valve and the first sensor is arranged in control communication with the control valve.

3. A gas supply arrangement according to claim 2, comprising a second sensor adapted for measuring the temperature in the ullage space section of the gas tank, and wherein the second sensor is arranged in control communication with the three-way valve.

4. A method of providing gas to a gas consumption device in a marine vessel with a liquefied gas tank having an ullage space section and liquid phase section, comprising:

evaporating gas in the gas tank and leading the evaporated gas to the consumption device via a gas supply line while substantially continuously measuring the pressure in the gas tank by a first sensor, controlling the evaporation rate of the gas in the gas tank by controllably spraying liquefied gas into the ullage space section of the gas tank, controlling the flow rate of sprayed liquefied gas based on the pressure measurement of the first sensor, and controlling the temperature of the sprayed gas based on temperature value measured by a second sensor provided in connection with the ullage space section of the gas tank.

5. A method according to claim 4, comprising controlling the evaporation rate of the gas by controlling the temperature of the sprayed gas.

* * * * *